United States Patent [19]

English et al.

[11] Patent Number: 4,939,324

[45] Date of Patent: Jul. 3, 1990

[54] KEYSWITCH FOR COMPUTER KEYBOARD

[75] Inventors: George P. English, Hayden Lake, Id.; Stephen S. Damitio, Spokane, Wash.

[73] Assignee: Key Tronic Corporation, Spokane, Wash.

[21] Appl. No.: 400,512

[22] Filed: Aug. 30, 1989

[51] Int. Cl.[5] ..... H01H 13/70

[52] U.S. Cl. ..... 200/345; 200/517; 200/520; 200/342; 200/341

[58] Field of Search ..... 200/341, 342, 345, 511, 200/517, 520, 521; 400/490, 495; 29/622

[56] References Cited

U.S. PATENT DOCUMENTS

| | | | |
|---|---|---|---|
| 3,190,982 | 6/1965 | Woodcock | 200/520 |
| 3,586,810 | 6/1971 | Brown | 200/520 |
| 3,624,330 | 11/1971 | Bogner et al. | 200/342 |
| 3,928,741 | 12/1975 | Comer | 200/345 |
| 4,467,160 | 8/1984 | Murmann et al. | 200/342 |
| 4,480,163 | 10/1984 | Morris et al. | 200/345 |

*Primary Examiner*—Henry J. Recla
*Assistant Examiner*—Keith Kupferschmid
*Attorney, Agent, or Firm*—Wells, St. John & Roberts

[57] ABSTRACT

A keyswitch operator includes a supporting bearing block and axially movable keytop and plunger. A cylindrical plunger is slidably guided between alternating flat and conical surfaces about a through bore in the bearing block. The flat surfaces provide constant bearing guides along multiple axial lines angularly spaced about the plunger. The conical surfaces provide draft to facilitate removal of a mold after forming of the through bore. Both "quiet tactile" and "click tactile" modes of operation are available when utilizing the keyswitch operator in conjunction with a yieldable dome overlying a membrane switch assembly. "Click tactile" operation requires the addition of a spring-biased piston to physically engage the underlying switch assembly when the plunger has been depressed.

17 Claims, 6 Drawing Sheets

KEYSWITCH FOR COMPUTER KEYBOARD

TECHNICAL FIELD

This disclosure relates to production and usage of mechanically movable keyswitches for computer keyboards.

BACKGROUND OF THE INVENTION

The present invention arose from an effort to economically produce computer keyboards in a manner compatible with production plastic molding procedures. It also was developed to permit conversion of keyswitch plugers, when used in combination with yieldable domes, from a "quiet tactile" operation (where the plunger engages switching elements under it through the dome) to a "click tactile" operation (where the plunger directly engages the switching elements).

Reciprocating keyswitch plungers require accurate fixed guide surfaces for ease of operation when the keyswitch is manually depressed. In the simplified form of keyswitch to which this disclosure is addressed, the guide surfaces are present in a bearing block fixed to the keyboard framework and overlying the switches or other electronic devices controlled by movement of the plunger. The guide surfaces are located along the interior of a through bore formed in the bearing block. The through bore has an axial length adequate to properly support the axially movable plunger. The cross sectional configuration of the through bore complement the cross sectional configuration of the plunger.

Since molded plastic resins tend to shrink onto interior metal molds used to form bores, it is necessary to provide draft or clearance in the design of the bore walls to assure mold removal without unplanned difficulty. However, a drafted bore presents non-uniform clearance along the length of the bore and reduces the quality of the sliding fit between the plunger and bearing block.

The present discovery provides the sliding plunger of a keyswitch operator with bearing surfaces that are parallel to the plunger axis, assuring that it is accurately guided when the associated keytop is manually depressed. The through bore containing the bearing surfaces is also provided with drafted surfaces that facilitate mold removal.

Computer keyboard technologies involving the use of yieldable domes provide the designer with ability to modify keyswitch force curves and tactile feedback to the user. When using a dome overlying a switch, such as a printed membrane switch, one can either engage the switch through the dome or through a piston protruding through the center of the dome. In the first instance, which is known as "quiet tactile" operation, the force curve will be dependent upon the design of the dome. It will constitute a relatively "soft" curve, where the force required to depress the keytop will initially increase and then abruptly decrease as the walls of the dome are inverted. In the second instance, which is known as "click tactile" operation, the initial force curve will be dependent upon the design of the dome, plunger, and piston, and upon the spring used to bias the piston against the dome.

In the "click tactile" operation the plunger mounts an axially movable piston which has an end protruding through the dome actuator. As the plunger is depressed, a spring between the plunger and the piston is compressed until it exerts sufficient force upon the piston and dome to invert the dome walls. Once the dome walls begin to invert the dome exerts less pressure to resist the force of the spring and piston. As a result, the spring accelerates the piston towards the underlying membrane switch assembly. When the protruding portion of the plunger subsequently bottoms out on the membrane switch assembly, it produces a "click" sound. Further depression of the plunger is then absorbed by the spring.

The present keyswitch assembly has been designed to be readily converted from "quiet tactile" to "click tactile" operation, depending upon the requirements of the keyboard user or consumer.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

This description pertains to computer keyswitch operators in manual keyboards. Such operators activate underlying switches or other electronic devices to communicate operator instructions to computers, calculators, and other electronic machines that process data and information. This present improvement pertains to the production and design of the reciprocating keyswitch components.

The details of membrane switch assemblies and yieldable domes are well known in computer keyboard technology. It is believed that the application of the mechanical components descibed herein to conventional membrane switch technology will be readily understandable to those having a background in this field. While the invention shall be described with reference to membrane switches, it is to be understood that it is equally applicable to capacitive keyswitch technology and to activation of any type of switching technology associated with an underlying support for sending signals toa computer in response to manual reciprocation of a keyswitch between a relaxed position and a depressed position.

For reference purposes in this description, the components of the keyswitch will be described in relation to their locations along the operative path of movement of the keyswitch plunger. The relaxed keyswitch position shall be termed its outer position and the depressed keyswitch position shall be termed its inner position. The corresponding axial ends of the keyswitch shall be arbitrarily labelled "outer" and "inner" in reference to these position along the keyswitch axis.

Figure 1:
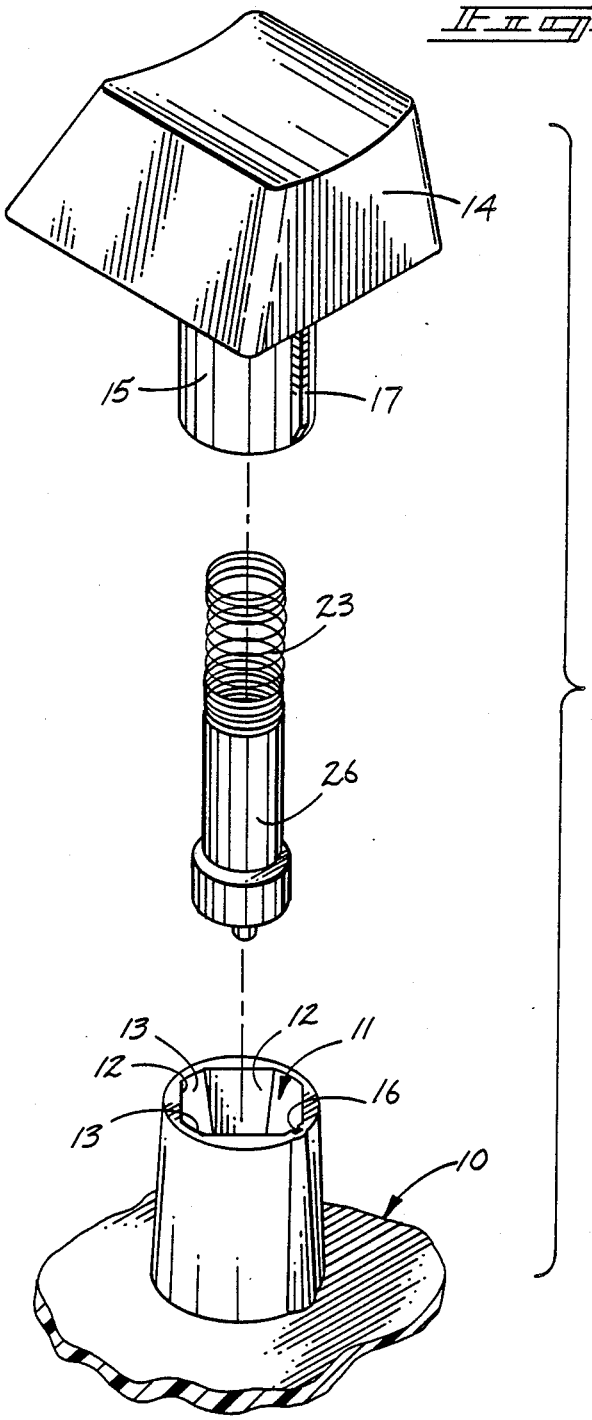
FIG. 1 is an exploded view of the components of the keyswitch operator.

The basic components of the computer keyswitch operator can be viewed in FIG. 1. They include a fixed bearing block 10 having a protruding section containing a through bore 11. The through bore 11 is defined by a plurality of wall segments that extend between outer and inner bore ends, shown respectively at the top and bottom of FIGS. 4–6. A cylindrical plunger 15 is coaxially mouted in the through bore 11 for slidable axial movement within it.

The plunger 15 supports a keytop 14 at its outer axial end. In most instances, pluger 15 and keytop will be integrally molded or fabricated. The plunger 15 projects inwardly from the keytop 14 and is slidably guided by the interior walls of through bore 11. Reciprocating movement of keytop 14 and plunger 15 relative to the bearing block 10 selectively actuates underlying switches or other electronic devices in the keyboard to communicate data to associated electronic components (not shown).

FIG. 1 also illustrates a piston 26 and biasing spring 23 normally within plunger 15. These optional components will be described below with regard to the alternative modes of using the keyswitch operator.

It is to be understood that bearing block 10 as illustrated in the drawings is merely a partial area in a larger keyboard component. A typical keyboard would include a plurality of keyswitch operators. Since they are each indentical in structure, only one has been shown in the drawings for illustrative purposes. In keyboard structures where individually molded keyswitch operators are desired, the bearing block 15 can be individually molded.

The wall segments of through bore 11 in bearing block 10 are centered along a central reference axis indicated by lines Y—Y in FIGS. 4 through 8. They include a plurality of sets of alternating first and second wall surfaces respectively indentified by the reference numerals 12 and 13. Wall surfaces 12 and 13 abut one another along their sides and extend axially between the outer and inner bore ennds in bearing block 10.

The first wall surfaces 12 are flat. They are located in planes parallel to and radially spaced from the reference axis Y—Y. The second wall surfaces 13 are sections of a cone that is coaxial with the reference axis Y—Y. Surfaces 13 diverge relative to reference axis Y—Y from the inner end of through bore 11 to its outer end.

The cylindrical plunger 15 has a constant outside radius along its full axial length. This radius complements and is just slightly less than the radial spacing between opposed flat surfaces 12 through the reference axis Y—Y. Plunger 15 is slidably guided in bearing block 10 along vertical midlines extending the full height of each flat surface 12. Although plunger 15 is cylindrical and the supporting surfaces 12 are planar, the provision of at least three sets of alternating wall surfaces 12 and 13 assures that the desired coaxial positioning of planar 15 and keytop 14 relative to reference axis Y—Y will be maintained throughout their axial travel.

Figure 4:
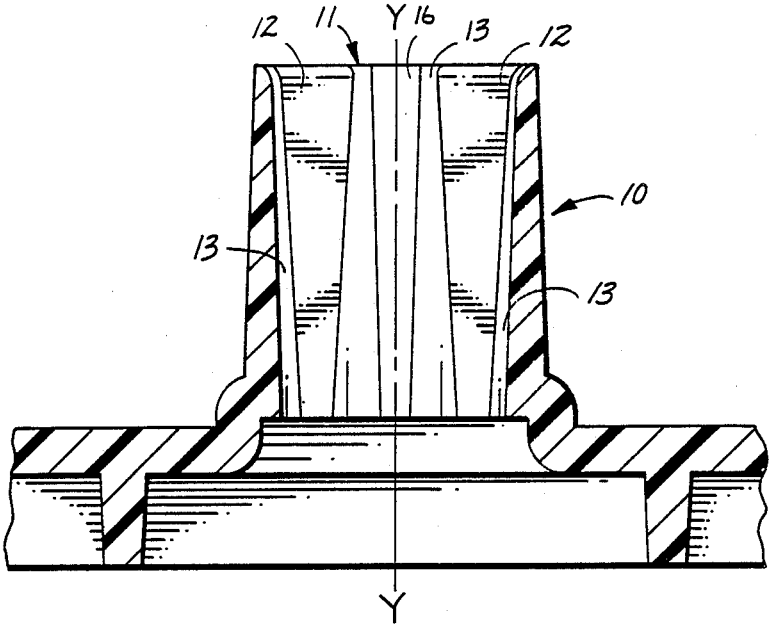
FIG. 4 is a section view as seen along line 4—4 in FIG. 2.
Figure 5:
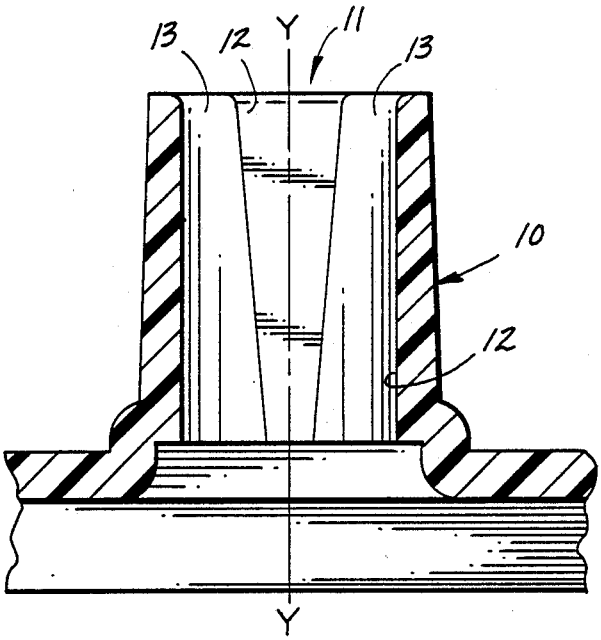
FIG. 5 is a section view as seen along line 5—5 in FIG.2.
Figure 6:
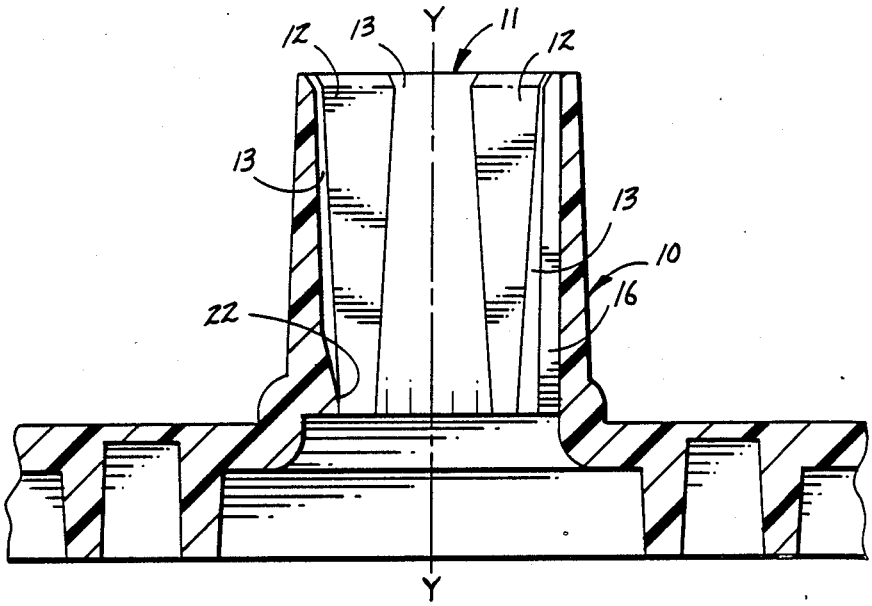
FIG. 6 is a section view as seen along line 6—6 in FIG. 2.

The differences between the alternating walls 12 and 13 can best be seen by comparing FIGS. 4 and 5. In FIG. 4, the illustrated sectional view is taken through the upright midlines of opposed conical surfaces 13, which diverge outwardly along the throuhg bore 11. In FIG. 5, the sectional view is taken along the midlines of opposed flat surfaces 12, which are parallel to reference axis Y—Y. The spacing between the diverging opposed pairs of conical surfaces 13, measured across axis Y—Y, is smallest at the inner end of through bore 11 and becomes progressively larger toward the outer end of through bore 11. Stated differently, the diametrical spacing between opposed flat surfaces 12 is constant along axis Y—Y from the inner end of through bore 11 to its outer end, while the corresponding diametrical spacing between conical surfaces 13 diverges from the inner end of through bore 11 to its outer end. The smallest diametrical spacing between conical surfaces 13 (at the inner end of through bore 11) is equal to or greater than the diametrical spacing between opposed flat surfaces 12.

In the illustrated embodiment, there are four sets of surfaces 12 and 13. The adjacent flat surfaces 12 are perpendicular to one another. The flat surfaces 12 engage the cylindrical plunger 15 along four lines positioned 90° apart about reference axis Y—Y.

The conical surfaces 13 provide diverging walls within through bore 11 to facilitate removal of mold components from within the through bore 11. They form sections of a drafted cylinder or conical frustum for mold removal purposes. The combination of flat surfaces 12 and conical surfaces 13 provides a through bore having relatively close dimensional tolerances for guiding purposes, while assuring adequate draft to facilitate mold removal.

Figure 7:
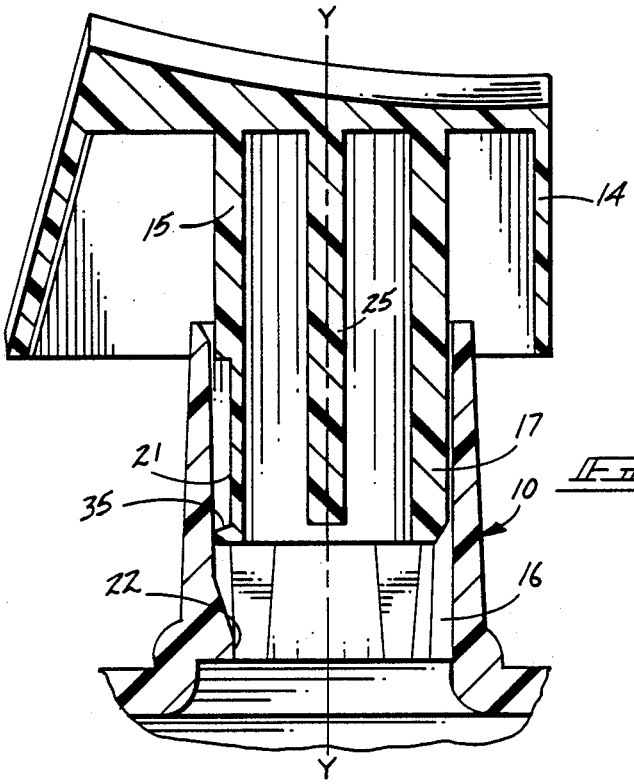
FIG. 7 is a fragmentary sectional view taken along the line 6—6 in FIG. 2, showing insertion of the plunger into the bearing component.
Figure 8B:
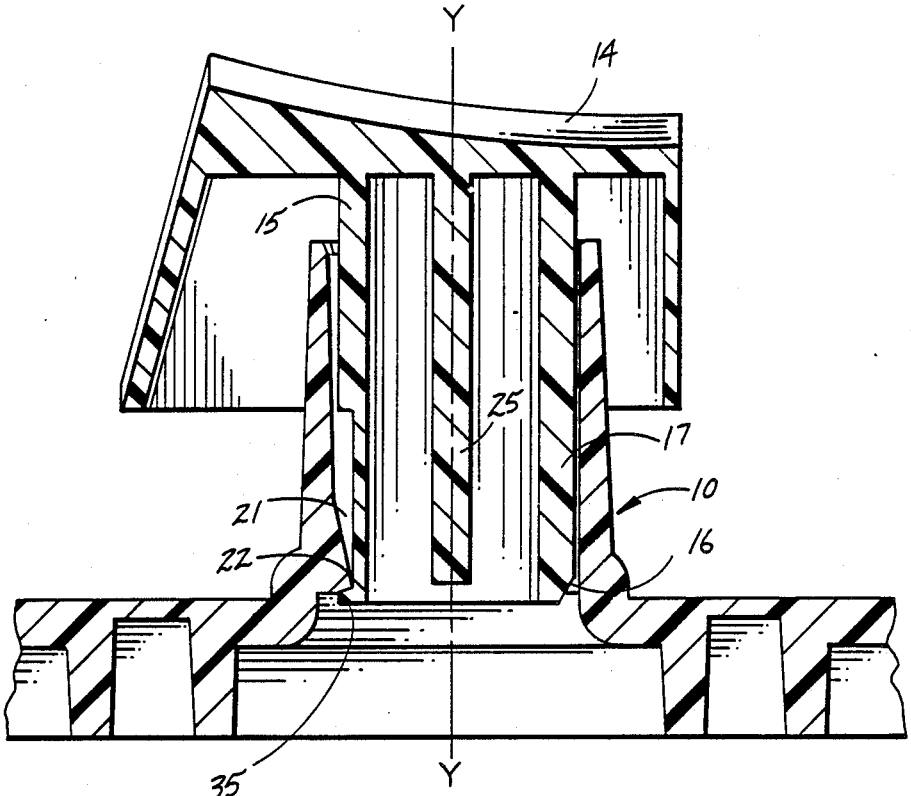
FIG. 8 is a view similar to FIG. 7, showing the assembled keyswitch operator.

Angular indexing of keytop 14 and plunger 15 relative to the bearing block 10 can be achieved by providing an axial keyway 16 along one of the wall surfaces 12 or13. In the preferred form illustrated, keyway 16 is formed along the midline of one of the conical wall surfaces 13. This is most clearly illustrated in FIGS. 2 and 3. The keyway 16 extends in an axial direction parallel to the reference axis Y—Y. It slidably receives a complementary key 17 along the exterior of plunger 15 (shown in FIGS. 1, 7 and 8). Key 17 also extends along an axial direction parallel to reference axis Y—Y. Key 17 can be sized to loosely fit within keyway 16, since precise indexing of keytop 14 relative to bearing block 10 is not vital to proper keyswitch operation. The plunger 15 is releasably interlocked within through bore 11 by engagement of a radial projection 22 within an axial groove 21. This is best seen in FIGS. 7 and 8, which illustrate progressive entry of a plunger 15 into a through bore 11. The projection 22 extends radially inward from one conical surface 13 at the inner end of through bore 11. It can be seen in plan in FIG. 3, where it is shown in a location radially opposite the keyway 16. Groove 21 on the plunger 15 has an axial length adequate to accommodate operational movement of plunger 15 relative to the bearing block 10. Its outer end is formed as a perpendicular shoulder. Its inner end is formed as a ramp 35 to facilitate removal of plunger 15 (discussed below). The groove 21 freely receives the projection 22, as seen in FIG. 8.

The complementary projection 22 and ramp 35 within groove 21 serve as "limit means" on the bearing block 10 and plunger 15, respectively, limiting normal outward movement of plunger 15 relative to bearing block 10. Since plunger 15 and bearing block 10 are each preferably molded from yieldable plastic materials, the plunger 15 can be manually pulled in an outward direction from within the through bore 11 when removal of plunger 15 is necessary. Such pulling force will cause the projection 22 to deflect radially outward and the ramp 35 to deflect radially inward. Thus, the keyswitch operator can be readily assembled or dissembled without special tools or connection procedures.

Because of molding tolerances and dimensional clearances provided between the plunger 15 and the walls of through bore 11, the individual keytops 14 in a keyboard may be subject to varying degrees of misalignment when at rest. This is countered by the combination of projection 22 that engages the lower end of plunger 15 and the coverging flat surfaces that engage plunger 15 at an axially spaced position located outward from the projection 22.

Figure 2:
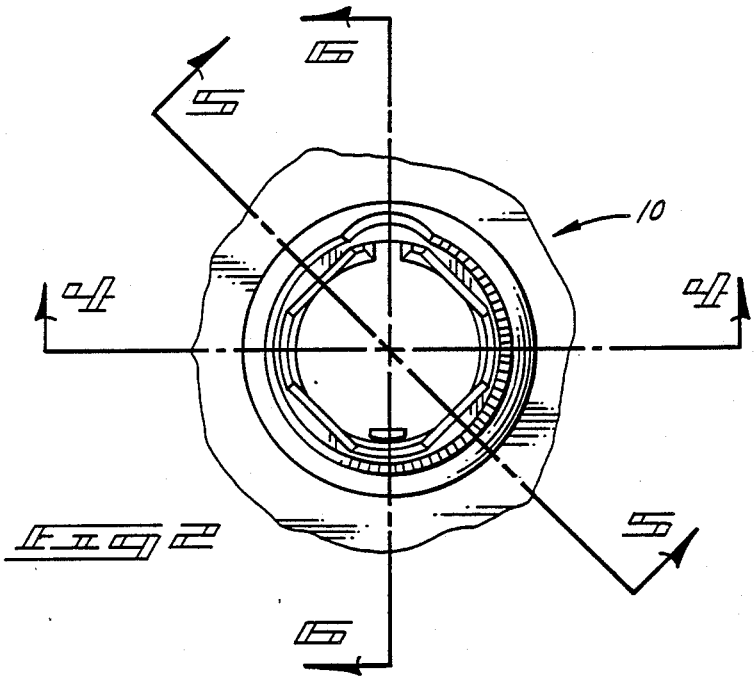
FIG. 2 is a top plan view of the plunger bearing shown in FIG. 1.
Figure 3:
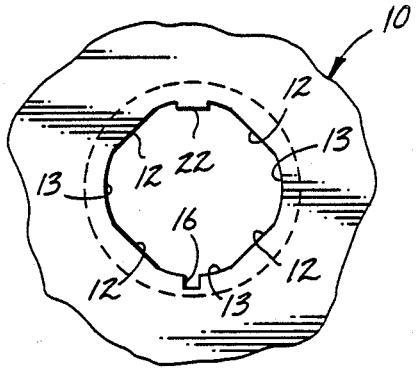
FIG. 3 is a bottom view of FIG. 2.

FIG. 2 is a plan view illustrating the bearing block 10 as viewed from the front of a keyboard. It is to be noted that the conical surfaces 13 are centered across perpendicular planes that extend transversely and from front to back, respectively, about the keyboard area. Conversely, the flat surfaces 12 in through bore 11 have a diagonal 45° orientation relative to these reference planes. As further described below, the diagonal orientation of flat surfaces 12, together with the interaction of projection 22 with groove 21 when the keys are at their rest position, assists in maintaining the keytops 14 in a regular and orderly position in relation to each other.

A yieldable dome 27 exerts an outward pressure on the plunger 15. Outward movement of plunger 15 is limited only by the interference between the groove 21 and projection 22 at the inner end of plunger 15. As a result, plunger 15, when at rest, will tend to pivot about ramp 35 as a fulcrum. If groove 21 and projection 22 are oriented toward the front of the keyboard, the outer portion of plunger 15 will be biased towards the front of the keyboard.

Since the projection 22 is oriented at 45 degrees between the flat surfaces 12, the plunger 15 at rest will wedge into the two flat surfaces. The common orientation of all plungers in a keyboard will thus bias all the plungers toward the front of the keyboard. This intentional biasing effectively limits the effect of molding tolerances on the various plastic parts. With the plungers 15, and therefore the keytops 14, thus biased, the keyboard takes on an orderly appearance. If this biasing were not intentionally done, some keytops 14 would be angularly oriented in a random, haphazard manner.

Figure 9:
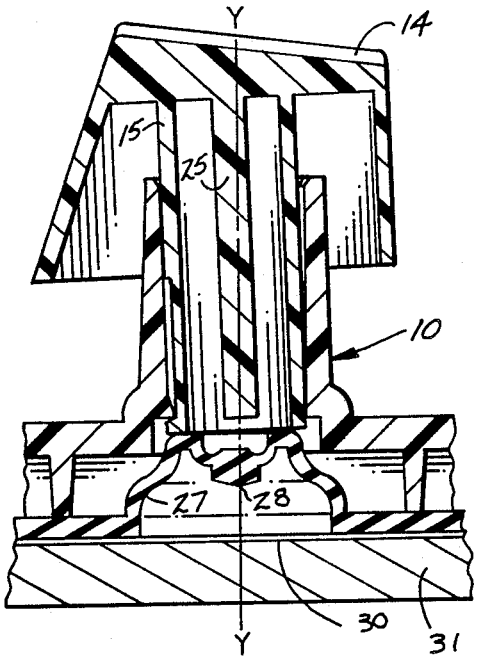
FIG. 9 is reduced scale sectional view similar to FIG. 8, illustrating "quiet tactile" usage.

The elements just described can be used to activate a keyboard membrane switch 30 fixed to a supporting base 31 in a "quiet tactile" mode of operation (see FIG. 9). In this mode of operation, the inner end of plunger 15 rests upon and engages the outer end of a yieldable dome 27 directly overlying printed switch elements (not shown) in a membrane switch assembly 30. The tactile "feel" or force curve encountered by the finger of a user depressing keytop 14 will be a function of the design of dome 27. This force curve will typically have an intermediate "breakaway" section, where the resisting force suddenly decreases following inversion of the dome 27. The operation of the underlying membrane switch elements will occur when the center button 28 of the dome 27 engages the membrane switch assembly 30.

Figure 10:
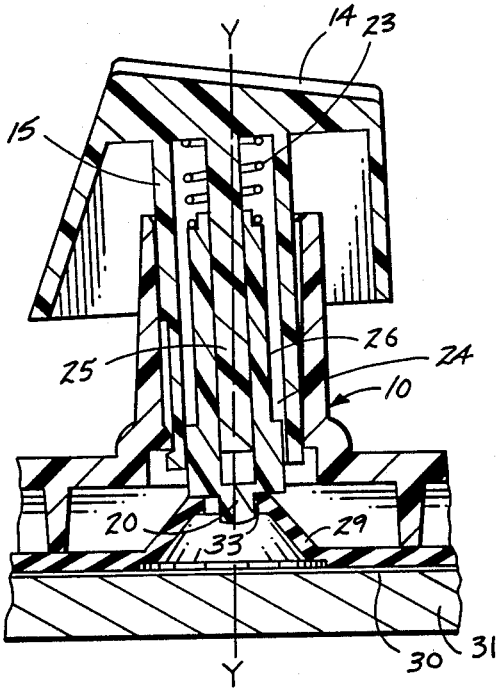
FIG. 10 is a modification of the assembly shown in FIG. 9, illustrating "click tactile" usage.

Because many users and consumers of computer keyboards desire an audible "click" when depressing a keyswitch, one can provide for such a feature by adding the optional piston 26 and spring 23 as seen in FIG. 1 and FIG. 10. This provides a "click tactile" mode of operation for the keyswitch operator.

To accommodate reception of the piston 26, an open coaxial cylindrical bore 24 is formed through the inner axial end of plunger 15, which is opposite to keytop 14. The cylindrical piston 26 is axially movable within the cylindrical bore 24. Compression spring 23 serves as light "biasing means" operatively connected between plunger 15 and piston 26 for normally urging the piston 26 to a position projecting axially inward beyond plunger 15.

A coaxial cylindrical pin 25 extends inwardly from keytop 14 within the cylindrical bore 24. Pin 25 is preferably molded integrally with plunger 15 and keytop 14. It is spaced radially inward from the walls of the cylindrical bore 24. Pin 25 serves as a guide to maintain the desired coaxial position of piston 26 within the surrounding plunger 15. It also is surrounded by compression spring 23 to insure proper axial positioning of spring 23 at all positions of the assembly.

In the arrangement shown in FIG. 10, the inner end of piston 26 directly engages the annular surface of a modified dome 29. The outer portion of dome 29 includes an open aperture 33. The inner end of piston 26 includes a center projection 20 extending through the aperture 33. In the "click tactile" mode of operation, the projection 20 is loosely received within an aperture 33 formed through the center of the dome 29 in place of the previously-described center button 28.

Because the force of the spring 23 in the non-depressed position is less than the biasing of resistive force of dome 29, depression of keytop 14 will cause the light spring 23 to compress against piston 26 until the force exerted by spring 23 is sufficient to deflect the dome 29 toward the underlying membrane switch 30. This will result in an inversion of the dome 29, with an abrupt decrease in resistive force from the dome 29 producing a "breakaway" feel. In addition, since the dome 29, after breakaway, exerts less force to resist the spring 23, spring 23 will then accelerate piston 26 toward the upper surface of membrane switch 30. The resulting engagement between piston 26 and membrane switch 30 will produce an audible click and positive physical contact that can be detected by the user's finger. Further depression of keytop 14 will then be absorbed by additional compression of spring 23.

As shown in FIGS. 9 and 10, the keyswitch operator can be readily configured for either mode of operation by either adding or removing the associated piston 26 and spring 23 and utilizing the appropriate dome configuration for biasing it. No other modifications or attachments are required to the basic keyswitch operator.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. In a keyswitch that is manually movable between a relaxed outer position and a depressed inner position:

a bearing block containing a through bore centered about a reference axis, the through bore being defined by a plurality of wall segments that extend between outer and inner bore ends;

the wall segments of the through bore including a plurality of alternating first and second wall surfaces abutting one another along their sides and extending axially between the outer and inner bore ends;

the first wall surfaces being flat and located in planes parallel to and radially spaced about the reference axis; and the second wall surfaces being sections of a cone centered on the reference axis that diverge from the inner bore end to the outer bore end.

2. The keyswitch of claim 1, further comprising:

a keytop;

a cylindrical plunger projecting inwardly from the keytop, the plunger being coaxially mounted within the through bore of the bearing block for slidable axial movement, the plunger having a radius complementary to the spacing between the reference axis and the first wall surfaces.

3. The keyswitch of claim 2, further comprising:

an axial keyway formed along one of the wall surfaces of the through bore; and a complementary axial key formed along the exterior of the plunger, the key being slidably received within the keyway for angularly indexing the plunger about the reference axis.

4. The keyswitch of claim 1, further comprising:

a keytop;

a cylindrical plunger having an outer plunger end fixed to the keytop and an inner plunger end, the plunger being coaxially mounted within the through bore of the bearing block for slidable axial movement relative to the bearing block and having a radius complementary to the spacing between the reference axis and the first wall surfaces; and limit means on the bearing block and plunger, respectively, for defining a maximum limit of axial movement between them.

5. The keyswitch of claim 4 wherein , the limit means comprises:

a projection extending radially inward from one of the second wall surfaces;

an axial groove formed in the cylindrical plunger at a location adjacent to its inner end for receiving the projection, the groove having outer and inner groove ends separated by an axial length adequate to accommodate axial movement of the cylindrical plunger relative to the bearing block as the keyswitch is moved between its relaxed and operative positions, the groove terminating at its inner end across a shoulder that abuts the radial projection to define an outward limit of plunger travel when the keyswitch is at rest.

6. The keyswitch of claim 5 wherein the first wall surfaces include a pair of converging walls in planes that intersect one another along the axial centerline of the projection so that abutment of the projection and groove shoulder will wedge an outer portion of the plunger between the pair of converging walls in response to outward pressure on the plunger.

7. The keyswitch of claim 5 wherein the shoulder formed across the inner end of the groove comprises a ramp complementary in shape to the projection to facilitate removal of the plunger from the through bore.

8. The keyswtich of claim 1, further comprising:

a keytop;

a cylindrical plunger having an outer plunger end fixed to the keytop and an inner plunger end, the plunger being coaxially mounted within the through bore of the bearing block for slidable axial movement relative to the bearing block and having a radius complementary to the spacing between the reference axis and the first wall surfaces; and an open coaxial cylindrical bore formed through the inner plunger end.

9. The keyswitch of claim 1, further comprising:

a keytop;

a cylindrical plunger having an outer plunger end fixed to the keytop and an inner plunger end, the plunger being coaxially mounted within the through bore of the bearing block for slidable axial movement relative to the bearing block and having a radius complementary to the spacing between the reference axis and the first wall surfaces;

an open coazial cylindrical bore formed through the inner plunger end;

a cylindrical piston axially movable within the cylindrical bore, and;

biasing means operatively connected between the plunger and piston for normally urging the piston toward the inner plunger end.

10. The keyswitch of claim 9, further comprising:

a coaxial center projection extending from the inner end of the piston;

a yieldable dome having an aperture in an upper surface for receiving the center projection.

11. The keyswitch of claim 1, further comprising:

a keytop;

a cylindrical plunger having an outer plunger end fixed to the keytop and an inner plunger end, the plunger being coaxially mounted within the through bore of the bearing block for slidable axial movement relative to the bearing block and having a radius complementary to the spacing between the reference axis and the first wall surfaces;

an open coaxial cylindrical bore formed through the inner plunger end; and a coaxial pin extending inwardly through the cylindrical bore, the pin being radially spaced from the walls of the cylindrical bore.

12. The keyswitch of claim 11, further comprising:

a cylindrical piston, the piston being slidably received within the cylindrical bore and having a coaxial bore that slidably receives the cylindrical pin; and biasing means operatively connected between the plunger and pistion for normally urging the piston toward the inner plunger end.

13. In a keyswitch that is manually movable between a relaxed outer postion and a depressed inner position:

a bearing block containing a through bore centered about a reference axis, the through bore being defined by a plurality of wall segments that extend between outer and inner bore ends;

the wall segments of the through bore including four sets of alternating first and second wall surfaces that abut one another along their sides and extend axially between the outer and inner bore ends;

the first wall surfaces being flat and located in planes that are parallel to and centered about the reference axis; and the second wall surfaces being sections of a cone centered on the reference axis that diverge from the inner bore end to the outer bore end.

14. The keyswitch of claim 13, further comprising:

a keytop;

a cylindrical plunger projecting inwardly from the keytop, the plunger being coaxially mounted within the through bore of the bearing block for slidable axial movement relative to it and having a radius complementary to the spacing between the reference axis and the first wall surfaces within the through bore.

15. The keyswitch of claim 14, further comprising:

an axial keyway formed along the center of one of the second wall surfaces of the through bore in an axial direction parallel to the reference axis; and a complementary axial key formed along the exterior of the plunger in a direction parallel to the reference axis, the key being slidably received within the keyway for angularly indexing the plunger with respect to the reference axis.

16. The keyswitch of claim 15, further comprising:

a projection extending radially inward from the inner end of the second wall surface radially opposite the keyway;

an axial groove formed in the cylindrical plunger at a location adjacent to its inner end for receiving the projection, the groove having outer and inner groove ends separated by an axial length adequate to accommodate axial movement of the cylindrical plunger relative to the bearing block as the keyswitch is moved between its relaxed and operative positions, the inner end of the groove being positioned on the plunger to abut with the radial projection and to prevent further outward movement of the plunger at the desired outer limit of plunger travel and being ramped to facilitate removal of the plunger from the through bore.

17. The keyswitch of claim 16 wherein the first wall surfaces include a pair of converging walls in planes that intersect one another along the axial centerline of the projection so that abutment of the projection and the inner end of the groove will wedge an outer portion of the plunger between the pair of converging walls in response to outward pressure on the plunger.

* * * * *